US007681317B2

(12) United States Patent
Fagan

(10) Patent No.: US 7,681,317 B2
(45) Date of Patent: Mar. 23, 2010

(54) ICICLE REMOVING TOOL

(76) Inventor: Edward V. Fagan, 100 Mildred Ave., North Syracuse, NY (US) 13212

( * ) Notice: Subject to any disclaimer, the term of this patent is extended or adjusted under 35 U.S.C. 154(b) by 153 days.

(21) Appl. No.: 11/703,265

(22) Filed: Feb. 7, 2007

(65) Prior Publication Data

US 2008/0184564 A1 Aug. 7, 2008

(51) Int. Cl.
*B26B 3/00* (2006.01)
*B26B 9/02* (2006.01)

(52) U.S. Cl. ..... 30/167; 30/169; 30/172; 30/351; 30/353; 30/356; 30/357

(58) Field of Classification Search ..... 30/167–172, 30/277, 280, 294, 299–301, 309, 314, 315, 30/317, 351, 353, 356, 357; 172/371–381; D8/9–12, 47, 76, 81, 89
See application file for complete search history.

(56) References Cited

U.S. PATENT DOCUMENTS

| | | | | | |
|---|---|---|---|---|---|
| 197,956 | A | * | 12/1877 | Walker | 172/375 |
| 298,926 | A | * | 5/1884 | Watson | 172/381 |
| 319,183 | A | * | 6/1885 | Boothby | 172/380 |
| 486,295 | A | * | 11/1892 | Pflueger | 30/171 |
| 1,043,758 | A | * | 11/1912 | Ferwerda | 172/371 |
| 1,211,655 | A | * | 1/1917 | Adams et al. | 172/380 |
| 1,240,199 | A | * | 9/1917 | Haas | 172/372 |
| 1,278,680 | A | * | 9/1918 | Klaffert | 30/315 |
| 1,317,596 | A | * | 9/1919 | Sanders | 172/375 |
| 1,437,199 | A | * | 11/1922 | Same | 30/314 |
| 1,516,789 | A | * | 11/1924 | Rassner | 30/314 |
| 1,679,806 | A | * | 8/1928 | Bockstadter | 30/314 |
| 1,684,444 | A | * | 9/1928 | Hayden | 172/380 |
| 1,687,986 | A | * | 10/1928 | Miller | 172/381 |
| 1,793,290 | A | * | 2/1931 | Pleas | 172/380 |
| 2,251,048 | A | * | 7/1941 | Garland | 172/372 |
| 2,383,388 | A | * | 8/1945 | Hughes | 172/375 |
| 2,542,582 | A | * | 2/1951 | Schwork | 30/314 |
| 2,594,598 | A | * | 4/1952 | Timmins | 172/380 |
| 2,606,050 | A | * | 8/1952 | Morris et al. | 172/371 |
| 2,812,700 | A | * | 11/1957 | Nelson | 172/380 |
| 3,367,704 | A | * | 2/1968 | Kleppin | 172/378 |
| 3,868,775 | A | * | 3/1975 | Anderson | 172/375 |
| 4,208,793 | A | * | 6/1980 | Sinnott | 30/299 |
| 4,334,583 | A | * | 6/1982 | Parker | 172/375 |
| 4,411,320 | A | * | 10/1983 | Hass | 30/315 |
| 4,458,415 | A | * | 7/1984 | Maher et al. | 30/277 |
| 4,790,388 | A | * | 12/1988 | Badham | 172/375 |

(Continued)

*Primary Examiner*—Jason Daniel Prone
(74) *Attorney, Agent, or Firm*—Bernhard P. Molldrem, Jr.

(57) ABSTRACT

A de-icicling tool has an icicle removing head mounted onto the distal end of an elongated handle. The head is formed of a generally flat blade and a mounting sleeve to that fits onto the distal end of the handle. The blade member has a series of triangular teeth in a concave arc along the front with each tooth having a point and beveled edges which meet at the associated point. The points of the teeth are rounded. The blade has at least one generally triangular notch formed along its rear thereof, each notch having a pair of beveled edges. There is one or more one round aperture in the blade, each with a beveled edge and with a diameter of three to five centimeters. The mounting sleeve includes a threaded socket adapted to accept a male thread of a standard broom handle or paint pole.

9 Claims, 2 Drawing Sheets

U.S. PATENT DOCUMENTS

| | | | | | |
|---|---|---|---|---|---|
| D300,715 | S | * | 4/1989 | Ragoonath | D8/12 |
| 4,865,372 | A | * | 9/1989 | Gabriel | 294/54.5 |
| 5,040,614 | A | * | 8/1991 | Nash | 172/18 |
| 5,097,910 | A | * | 3/1992 | Traczek | 172/375 |
| 5,529,130 | A | * | 6/1996 | Suk | 172/380 |
| 5,799,996 | A | * | 9/1998 | Fredrickson | 294/51 |
| D407,955 | S | * | 4/1999 | Bierman | D8/10 |
| 5,964,299 | A | * | 10/1999 | Padgett | 172/380 |
| 6,446,733 | B2 | * | 9/2002 | Johnson | 172/377 |
| 6,526,619 | B1 | * | 3/2003 | Cassels, Jr. | 172/372 |
| D495,568 | S | * | 9/2004 | Register | D8/10 |

* cited by examiner

ICICLE REMOVING TOOL

BACKGROUND OF THE INVENTION

This invention relates to hand tools and implements for clearing ice from eaves, soffits, and roofs, and is more particularly concerned with a tool and technique for safely cutting icicles that may form along the roof of a home or other structure.

During winter, snow that falls on a building roof can melt and run down the edge of the roof, where it re-freezes, forming icicles. These icicles can pose a safety concern for persons or property directly below the eaves of the roof. In addition as the icicles grow they can become quite heavy, and their weight can actually damage the roof or rain gutters. Accordingly, there has been a concern for removing icicles before a dangerous or damaging event occurs. It is common for a homeowner or building maintenance person to try to knock down the icicles with a pole. In some cases persons have used an axe to chop at the ice when the icicle is particularly large. Where the icicle is above the first floor of the building, the can involve chopping at the icicle while standing on a ladder, which is an unsafe practice. However, there has not been a tool devised for attacking icicles, and for removing them in a safe manner.

OBJECTS AND SUMMARY OF THE INVENTION

Accordingly, it is an object of this invention to provide tool for safe, effective removal of icicles, and which avoids the drawbacks of the prior art.

It is another object to provide a de-icicling tool that is of simple, sturdy construction.

It is a further object to provide a de-icicling tool that can be used for any of a variety of sizes of icicles, and which can be used for safely removing icicles that are well above the head of the person.

In accordance with an aspect of the present invention, an icicle removing tool has an elongated handle or pole, and an icicle removing head mounted onto the distal end of the handle member. The icicle removing head has a generally flat blade member having a front and a rear, and top and bottom sides. The blade member is secured, e.g., by welding, onto a mounting sleeve, and this can have a threaded socket for receiving the distal end of the handle. There is a series of triangular teeth formed along the front of the blade member, with each tooth having a point (which can be rounded, i.e., blunt) and beveled edges which meet at the associated point. There can also be one or more generally triangular notches formed along the rear of the head, with each notch having a pair of beveled edges. There can also be circular or oval cutouts or apertures, the aperture(s) having an inwardly directed beveled edge. The front teeth cut into the ice and can be used for chopping the icicle in the forward direction. The rear notches can be used for breaking off icicles on the withdrawal stroke or back stroke. The hole can be used for removing smaller icicles. The head can be placed over the smaller icicles, allowing the icicle to penetrate into the aperture or hole, and then the tool is pushed or pulled to break the icicle off. These round apertures may have a diameter of three to five centimeters.

Preferably the mounting means in the sleeve employs a threaded socket adapted to accept a male thread of a standard broom handle. A set screw in the socket locks the handle member in place.

The blade and socket can be formed of a durable steel, and can be attached to a number of suitable types of handle. An adjustable length handle would permit the user to reach icicles formed above the building's second story.

The above and many other objects, features, and advantages of this invention will become apparent to persons skilled in the art from the ensuing description of a preferred embodiment, which is to be read in conjunction with the accompanying Drawing.

DETAILED DESCRIPTION OF THE PREFERRED EMBODIMENT

Figure 1:
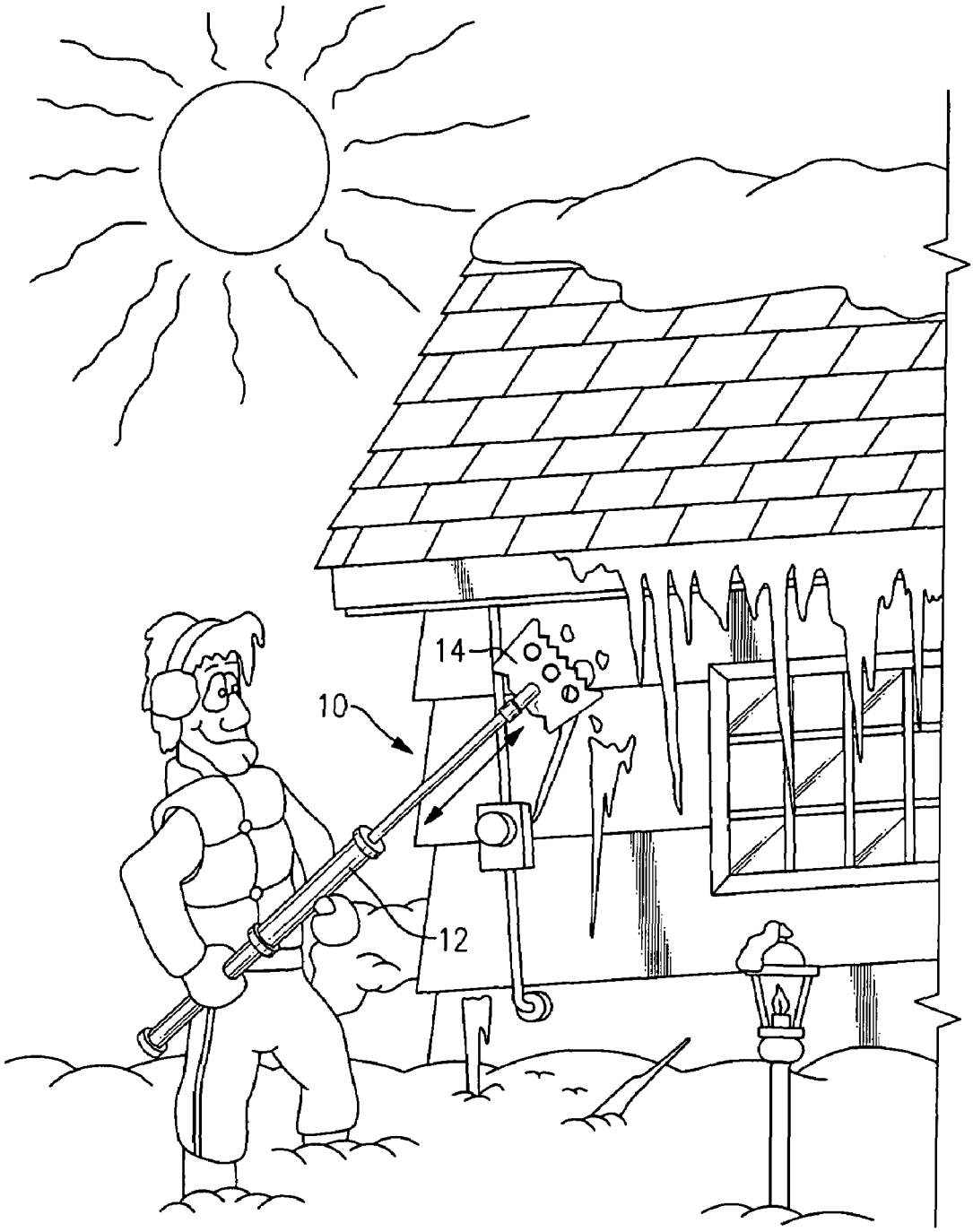
FIG. 1 is a perspective showing a homeowner using the tool according to an embodiment of the present invention.

With reference to the Drawing, FIG. 1 illustrates the technique for employing the icicle removing device 10 of an embodiment of this invention. Here a homeowner is shown holding a handle 12 of the device. In this example, the handle 12 is an extensible device, in which the length can be adjusted, permitting the homeowner to reach icicles fanned at any of a variety of roof heights. At the distal or forward end of the handle 12 is a de-icicling head 14, which is shown in more detail in FIGS. 2 and 3. The head has a row of triangular teeth along its forward edge or front, a pair of notches along its proximal edge or back, and a set of round openings. The homeowner can chop at the icicle so that the front teeth sink into the ice, and this usually severs the icicle in no more than a few blows. For smaller icicles, the homeowner lifts the head so that the icicles penetrate the hole, and then the icicle can be broken off. The notches can be used for pulling at the icicle, and cutting it at the back stroke or draw stroke. In each case, the homeowner does not stand directly beneath the icicle, and so is not in danger of being struck by the icicle when it falls. Also, the icicles can be taken down without need to climb on a ladder or platform.

The head 14 is of steel construction, and is strong and durable. Plastic or aluminum could also be used, but in that case a suitable plastic composition or aluminum alloy should be selected to have sufficient rigidity and strength, with being unduly brittle.

Figure 2:
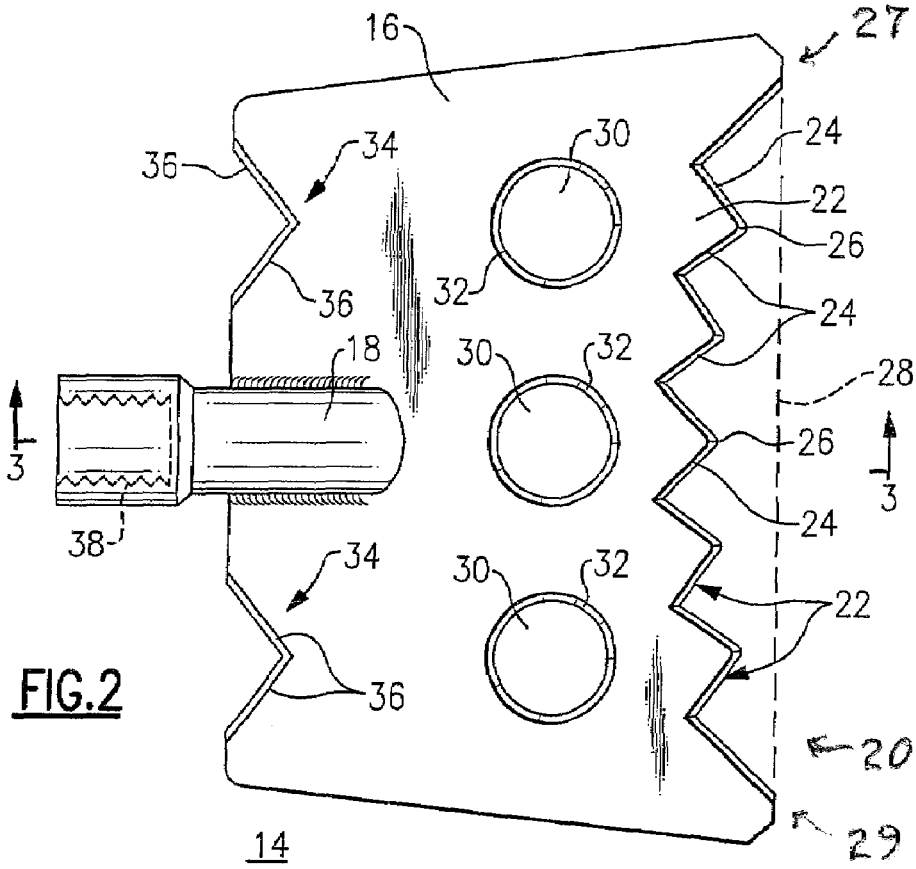
FIG. 2 is a plan view of the head of the tool.
Figure 3:
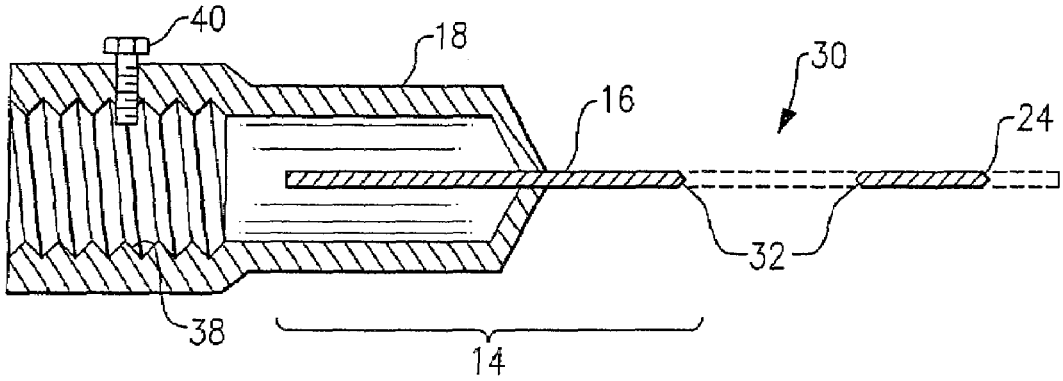
FIG. 3 is a sectional view taken at line 3-3 of FIG. 2.

As shown in more detail in FIGS. 2 and 3, the de-icicling head 14 is formed of a flat steel blade 16 that is mounted on a tubular fitting 18, i.e., a pipe, which receives the end of the handle 12. The blade 16 has a front 20 on which are formed a row of generally triangular teeth 22. These teeth each have a pair of beveled edges 24 that meet to form a point 26. In this case, the points 26 of the teeth are rounded or blunt, which makes the device safer for the user to handle, but still penetrates the ice well. The teeth 22 are arranged in an arc, which is concave or recessed behind the a line, identified as 28, between the left and right end portions 27, 29, respectively, of the blade front 20.

Partway back from the front 20 there are one or more round holes or apertures 30, each being about 1½ to 2 inches in diameter, i.e., about 3 cm to 5 cm, and each having an inwardly directed beveled edge 32. In this embodiment there are three of these apertures 30, but in other embodiments there could be more, or perhaps just one or two. These apertures serve to relieve some of the weight of the steel plate blade 16, and also provide the user with an optional means for removing some of the smaller icicles.

At the rear or the head 14 there are generally triangular or V-shaped notches 34 formed on the blade 16, and in this embodiment there are two notches, one on each side of the handle fitting 18. These notches 34 each have a pair of beveled edges 36. The notches provide a means for removing icicles by catching and then pulling against the icicle.

The tubular handle fitting 18 is attached to the blade 16, preferably by welding. In this embodiment, the tube is slitted and fitted over the blade 16, and then weld beads are formed along the join, on both sides and on the top and bottom. A threaded socket 38 is formed at the proximal end of the fitting 18, and is provided with female or internal threads adapted to match the standard threads of a paint pole or push broom handle. This permits the head 14 to be used on any common pole, in addition to an extensible pole such as the handle 12 shown in FIG. 1. As shown in FIG. 3, a set screw 40 can be provided for locking the handle 12 in place in the fitting 18.

In a possible alternative embodiment, the head 14 may be arranged at an angle to the shaft of the handle 12. This may be accomplished by affixing the fitting 18 at an angle, e.g., 60° or 90°, relative to the blade 16, rather than in the same plane. There may be an auxiliary socket for this purpose, or the handle 12 may have a tip that is angled relative to the shaft.

While the invention has been described in detail with respect to one preferred embodiment, it should be recognized that there are many alternative embodiments that would become apparent to persons of skill in the art. Many modifications and variations are possible which would not depart from the scope and spirit of this invention, as defined in the appended claims.

I claim:

1. An icicle removing tool formed of an elongated handle member having a distal end and an icicle removing head mounted onto the distal end of said handle member;

the icicle removing head comprising a generally flat blade member having a front, a rear, and top and bottom sides; and a mounting sleeve to which the blade member is secured and including means for mounting onto the distal end of said handle member;

said blade member including left and right end portions of the front thereof at respective corners of said front; a series of generally triangular teeth formed along the front of the blade member between said right and left end portions, each tooth having an apex and substantially linear beveled cutting edges which taper from both the top and bottom sides, and said cutting edges meet at the associated apex wherein said front is in the form of a generally concave arc formed between said left and right end portions, and wherein said series of teeth follow said arc and are situated behind a line between said right and left end portions; and wherein the left and right end portions of the front of said blade member are substantially flat and substantially blunt.

2. The icicle removing tool of claim 1 wherein blade member has at least one generally triangular notch formed along the rear thereof, said at least one notch having a pair of beveled edges.

3. The icicle removing tool of claim 1 wherein said blade includes at least one round generally circular aperture, the aperture having an inwardly directed circular beveled edge.

4. The icicle removing tool of claim 3 wherein said at least one round aperture has a diameter of three to five centimeters.

5. The icicle removing tool of claim 3 wherein said circular beveled edge angles from both said top and bottom sides.

6. The icicle removing tool of claim 1 wherein the mounting means of said sleeve includes a threaded socket adapted to accept a male thread of a broom handle.

7. The icicle removing tool of claim 6 wherein the mounting means further includes a set screw in said socket for locking the handle member in place.

8. The icicle removing tool of claim 1 wherein said beveled edges have surfaces that angle away from the top and bottom sides towards one another.

9. The icicle removing tool of claim 1 wherein said handle member includes an extensible handle of which the length thereof can be adjusted.

* * * * *